US005934228A

United States Patent [19]

Wheat

[11] Patent Number: 5,934,228

[45] Date of Patent: Aug. 10, 1999

[54] ADJUSTABLE COMBUSTION CHAMBER INTERNAL COMBUSTION ENGINE

[76] Inventor: Fred O. Wheat, 1005 Hwy. 1807, Venus, Tex. 76087

[21] Appl. No.: 09/001,564

[22] Filed: Dec. 31, 1997

[51] Int. Cl.[6] ..... F02B 75/04

[52] U.S. Cl. ..... 123/48 C; 123/78 C

[58] Field of Search ..... 123/48 R, 48 C, 123/78 R, 78 C

[56] References Cited

U.S. PATENT DOCUMENTS

| | | | |
|---|---|---|---|
| 1,125,375 | 1/1915 | Newton et al. | 123/48 C |
| 2,375,183 | 2/1945 | Arden . | |
| 3,340,858 | 9/1967 | Gerin | 123/78 C |
| 3,386,424 | 6/1968 | Appeman | 123/48 C |
| 4,144,851 | 3/1979 | Prosen | 123/48 C |
| 4,190,024 | 2/1980 | Davis . | |
| 4,873,947 | 10/1989 | Ryan et al. | 123/78 C |

*Primary Examiner*—Marguerite McMahon
*Attorney, Agent, or Firm*—David W. Quimby

[57] ABSTRACT

A two stroke engine having a variable compression ratio combustion chamber wherein the size of the combustion chamber is changed by threading a closure into or out of the combustion chamber. The combustion chamber is defined by the inside surface of a sleeve, the top surface of a piston, and the bottom surface of the closure. The piston and the sleeve reciprocate within the engine block in a not quite opposite manner. Inlet ports and outlet ports in the sleeve and engine block regulate the flow of gas into and out of the combustion chamber. The engine is equipped with a turbocharger system to provide air to the engine, and the engine is fuel injected.

13 Claims, 3 Drawing Sheets

ADJUSTABLE COMBUSTION CHAMBER INTERNAL COMBUSTION ENGINE

BACKGROUND OF THE INVENTION (1) Field of the Invention

This invention relates to an internal combustion engine, and more particularly to a two-stroke internal combustion engine having an adjustable combustion chamber for varying the compression ratio of the engine, a reciprocating sleeve for controlling gas flow into and out of the combustion chamber, and a turbocharger system for providing air to the engine.

(2) Description of Related Art

Variable compression ratio (VCR) internal combustion engines allow for improved efficiency, and reduced emissions as compared to fixed compression ratio internal combustion engines. The efficiency of the standard engine varies for different loads demanded from the engine. A VCR internal combustion engine allows the volume of the combustion chamber to be adjusted when the load on the engine varies. The volume change allows the engine to operate most efficiently at the highest possible trouble-free compression ratio.

An internal combustion engine operates most efficiently at the highest compression pressure possible without creating problems. This condition can only exist when there is no restriction to the entrance of air into the combustion chamber. Any reduction in the entrance of air into the cylinder, to reduce power or reduce speed, reduces the efficiency of the engine. All engines, except compression ignition engines, with a fixed compression ratio reduce speed and power by increasing the inefficiency of the engine. In an engine having variable compression pressure, the reduction in speed and power can be accomplished without reducing the efficiency of the engine by maintaining maximum possible compression pressure at the highest possible safe level.

There are several different types of variable compression ratio engines described in the prior art. For example, U.S. Pat. No. 2,375,183 issued to Arden discloses a variable compression ratio engine which uses a movable head insert that is placed inside the cylinder over the piston. The size of the compression chamber is automatically controlled by biasing means between the head insert and the cylinder head. The biasing means opposes the compression pressure exerted on the head insert during operation of the engine to control the change of volume of the combustion chamber.

Another type of variable compression ratio internal combustion engine is disclosed in U.S. Pat. No. 4,190,024 issued to Davis. This type of engine uses a flexible fluorocarbon membrane to set the volume of the combustion chamber. The flex of the membrane is controlled by a contra piston and screw mounted in the head of the engine.

A problem with most two-stroke engines is that the exhaust ports remain open even after the inlet ports have closed. This decreases the efficiency of the engine since fuel is allowed to escape through the exhaust ports without having been combusted. These engines pollute the atmosphere with raw fuel.

A two-stroke engine does not have a true suction stroke as do four-stroke engines. Therefore, fuel and air must be forced into the combustion chamber by other means. There are two common ways of forcing air into the combustion chamber. One way uses the upward stroke of the piston to draw air into the crankcase. On the downward stroke of the piston, the air is forced through passages into the combustion chamber. The upward stroke of the piston compresses the air in the combustion chamber. The other way is to have an external source of compressed air connected to the combustion chamber.

One method of increasing the amount of air supplied to an engine is to use a turbocharger. Turbochargers work by using exhaust gases from the engine to drive a compressor which supplies fresh air to the combustion chamber. A standard turbocharger does not operate until the engine is producing exhaust gas. Also, a turbocharger tends to lag behind the air supply requirements of an accelerating engine.

SUMMARY OF THE INVENTION (1) Progressive Contribution to the Art

I have invented an improved efficiency two-stroke internal combustion engine which has a variable compression ratio combustion chamber. The variable compression ratio engine allows the engine to run at the maximum safe compression pressure. The combustion chamber of the engine is defined by a sleeve, a closure, and a piston positioned in an engine block. The closure is threaded onto the top of the sleeve. Rotating the closure changes the position of the closure relative to the sleeve; thus changing the volume of the combustion chamber and the compression ratio.

The sleeve and the piston connect to a crankshaft of the engine so that reciprocating motion of the sleeve and the piston translates into rotary motion of the crankshaft. The sleeve has a shorter range of motion than does the piston. Also, the motion of the sleeve relative to the piston is in a not quite opposite manner, so that for most of the downward travel motion of the sleeve, the piston is moving upwards.

The sleeve has two rows of ports around the sleeve's circumference. The sleeve ports align with passages in the engine block to allow exhaust gases to be moved out of the combustion chamber, and to charge the combustion chamber with fresh air. For a brief period of time, after the exhaust passage to the engine block is closed by the reciprocating motion of the sleeve, the inlet passage into the combustion chamber remains open. During this time, fuel is injected into the combustion chamber. Then the piston closes off the inlet port and the inlet passage, and the upward stroke of the piston compresses the fuel and air mixture.

The engine has two turbochargers connected in series which can produce a maximum manifold pressure of approximately 100 psi. The turbocharger which takes in atmospheric air has a small liquid driven turbine connected to the shaft of the compressor wheel. The impeller of the liquid driven turbine is driven by a small, low volume-high pressure liquid pump. The liquid driven turbine allows the turbocharger system to provide enough air to the combustion chamber at start up. Also, the liquid driven turbine minimizes the problem of the turbocharger system lagging behind the needs of the engine when the engine accelerates.

(2) Objects of this Invention

An object of this invention is to provide the most efficient engine.

Further objects are to achieve the above with a device which is sturdy, compact, durable, light-weight, simple, safe, versatile, ecologically compatible, energy conserving and reliable; yet is inexpensive and easy to manufacture, install, maintain and use.

The specific nature of the invention, as well as other objects, uses, and advantages thereof, will clearly appear from the following description and from the accompanying drawings, the different views of which are not necessarily scale drawings.

Figure 1:
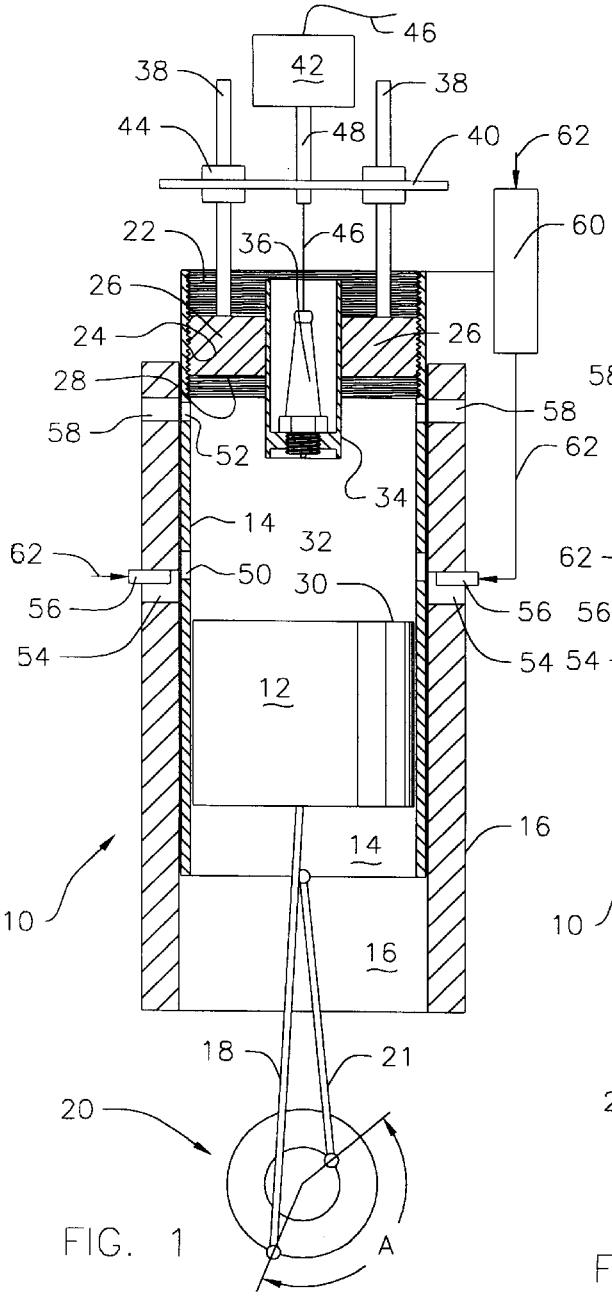
FIG. 1 is a simplified sectional view of the engine at a time when air is purging the combustion chamber.

As an aid to correlating the terms of the claims to the exemplary drawings the following catalogue of elements is provided:

10 engine
12 piston
14 sleeve
16 engine block
18 connecting rod
20 crankshaft
21 connecting rod
22 threads
24 threads
26 closure
28 bottom surface
30 top surface
32 combustion chamber
34 plug holder
36 spark plug
38 stud
40 drive plate
42 drive mechanism
44 bearing
46 spark plug wire
48 shaft
50 inlet port
52 exhaust port
54 inlet port
56 fuel injector
58 exhaust port
60 fuel pump
62 fuel line
64 turbocharger system
66 first turbocharger
68 second turbocharger
70 liquid driven turbine
72 gas turbine
74 gas turbine
76 exhaust system
78 compressor
80 compressor

DESCRIPTION OF THE PREFERRED EMBODIMENTS

With reference to the drawings, an engine is designated generally as 10. The engine 10 includes piston 12 which moves within sleeve 14. The sleeve 14 moves within a cylinder in engine block 16. Connecting rod 18 connects the piston 12 to crankshaft 20, and connecting rods 21 connect the sleeve 14 to the crankshaft. Reciprocating motion of the sleeve 14 and piston 12 translate into rotary motion of the crankshaft 20. As shown in FIG. 1, the sleeve and the piston are offset by angle A. Angle A should be approximately 152 degrees. When angle A is properly set, the motion of the sleeve 14 relative to the piston 12 is in a not quite opposite manner, so that for most of the downward travel motion of the sleeve, the piston is moving upwards.

A portion of the inside surface at the top of the sleeve 14 has threads 22. Threads 24 on closure 26 mate with the threads 22 on the inside surface of the sleeve 14. The volume defined by bottom surface 28 of the closure 26, the inside surface of the sleeve 14, and top surface 30 of the piston 12 defines combustion chamber 32.

The closure 26 has plug holder 34 positioned in the center of the closure. The plug holder 34 is stationary with respect to the engine block 16 when the engine 10 is running. Typical piston rings (not shown) provide seals between the closure 26 and the plug holder 34, between the sleeve 14 and the engine block 16, and between the sleeve and the piston 12. Spark plug 36 is positioned in the plug holder 34. In a Diesel type engine (not shown) in which ignition of the fuel is caused by the heat generated by the compression of the fuel-air mixture, the plug holder and spark plug are not necessary.

The closure 26 has studs 38. The studs 38 are connected by drive plate 40 to drive mechanism 42. The drive mechanism 42 rotates the closure 26 which changes the volume of the combustion chamber 32 by threading the closure 26 onto or out of the sleeve 14. The threaded length of the sleeve 14 allows for compression ratios between approximately 50:1 to 6:1. The drive mechanism 42 is preferable a reversible speed reducer, 12V DC motor. The drive mechanism is stationary with respect to the engine block 16 when the engine 10 is running. The studs 38 are long enough to accommodate the reciprocating motion of the closure 26 and sleeve 14. The studs 38 are attached to the drive plate 40 with linear bearings 44 to minimize friction associated with the reciprocating motion of the closure 26 and sleeve 14. Spark plug wire 46 passes through shaft 48 of the drive mechanism 42.

The sleeve 14 has inlet ports 50 and exhaust ports 52. The inlet ports 50 align with inlet ports 54 in the engine block 16 to allow air and fuel into the combustion chamber 32. Two of the inlet ports 54 in the engine block 16, which are on opposite sides of the combustion chamber 32, have fuel injectors 56. The exhaust ports 52 of the sleeve 14 align with exhaust ports 58 in the engine block 16 to provide an exit for combustion gases from the combustion chamber 32.

FIGS. 1 through 4 show various points during an engine cycle. The crankshaft 20 of the engine 10 represented in the figures rotates clockwise when the engine is running. FIG. 1 shows the engine 10 at the beginning of a cycle when air flows through the inlet ports 54 in the engine block 16, the inlet ports 50 in the sleeve 14, and into the combustion chamber 32. At this time, the exhaust ports 52 in the sleeve 14 are also aligned with the exhaust ports 58 in the engine block 16 so that entering air flows through the combustion chamber 32 and purges exhaust gases out of the combustion chamber.

Figure 2:
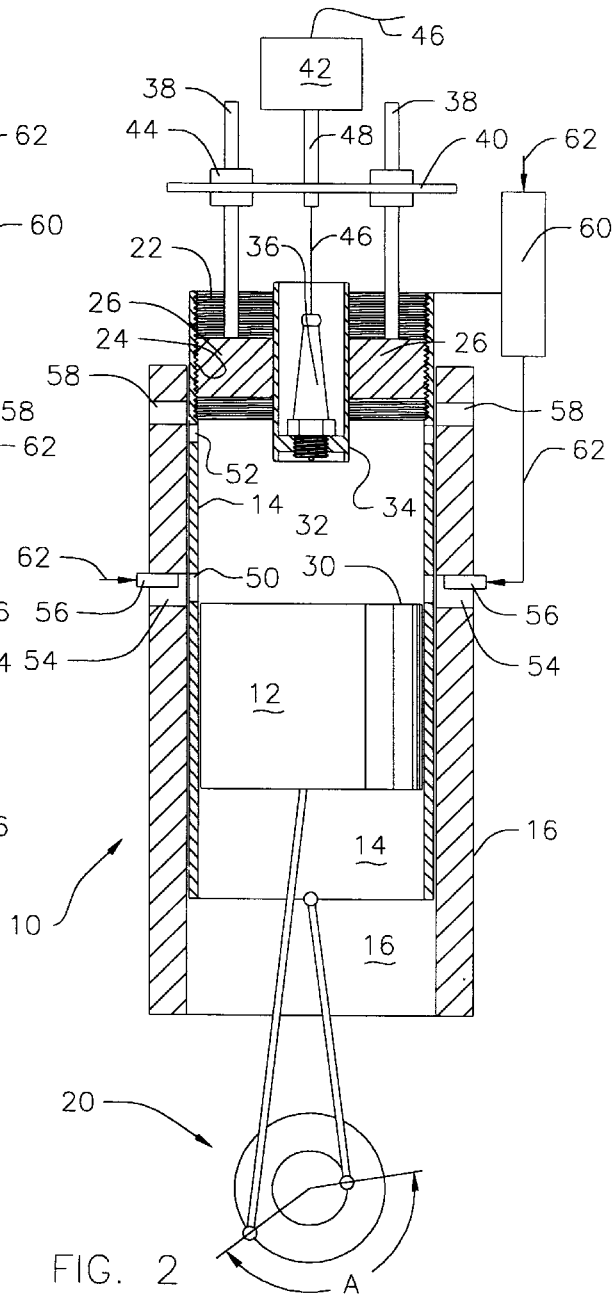
FIG. 2 is a simplified sectional view of the engine at a time when fuel is injected into the combustion chamber.

FIG. 2 shows the engine 10 immediately after the exhaust ports 58 of the engine block 16 have been closed by the movement of the sleeve 14. At this time and for the brief time until the movement of the piston 12 and sleeve 14 close the inlet ports 54 to the engine block 16, fuel is injected into the combustion chamber 32 through the fuel injectors 56. The fuel system comprises a low pressure, high volume battery operated supply pump (not shown) which delivers fuel to high pressure, low volume fuel pump 60, which sends fuel through fuel lines 62 to the fuel injectors 56. The fuel pump 60 is driven directly by the reciprocating motion of the sleeve 14.

Figure 3:
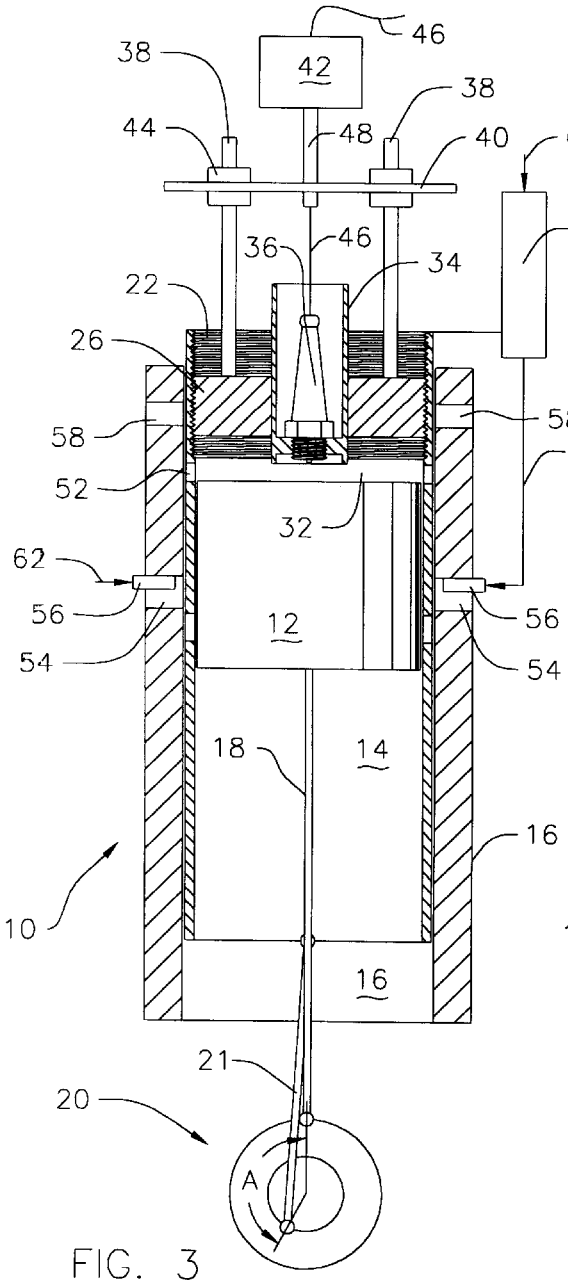
FIG. 3 is a simplified sectional view of the engine at the end of the compression stroke of the piston.
Figure 4:
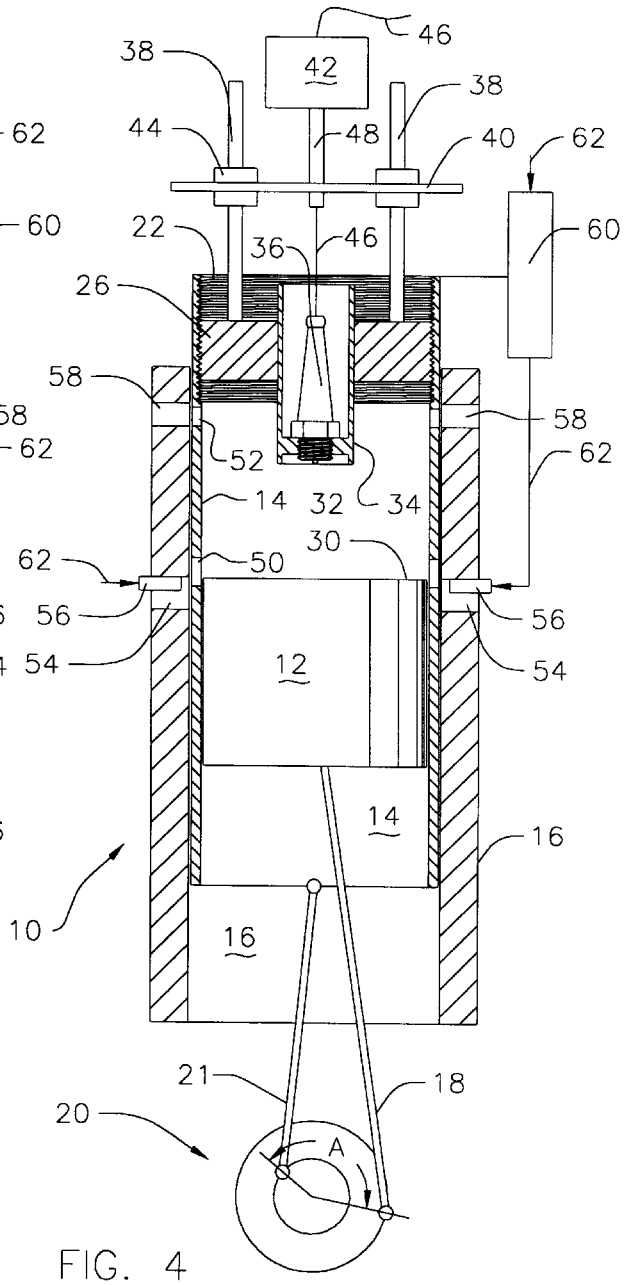
FIG. 4 is a simplified sectional view of the engine after combustion of the fuel.

FIG. 3 shows the engine 10 near the end of a compression stroke. The fuel is then ignited by the spark plug 36. FIG. 4 shows the engine 10 after combustion of the fuel. The exhaust ports 52, 58 are aligned, allowing exhaust gases to pass to turbocharger system 64.

Figure 6:
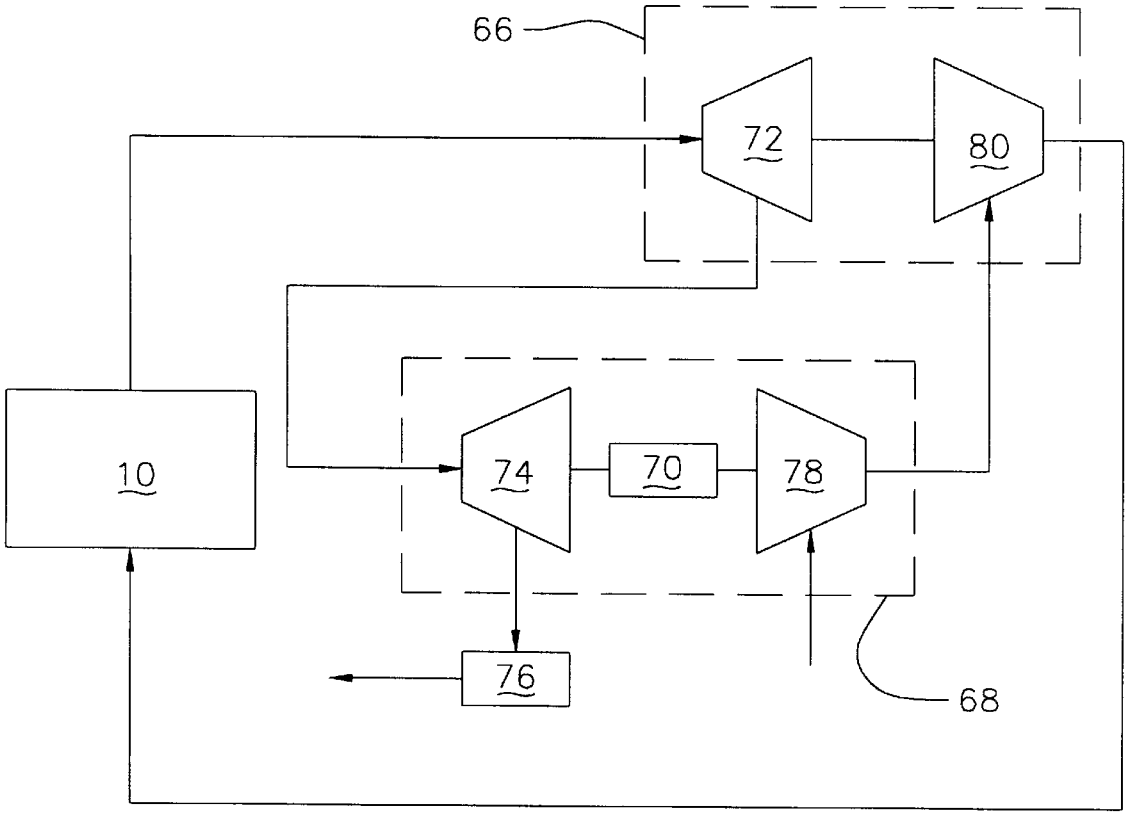
FIG. 6 is a schematic view of the turbocharger system.
Figure 5:
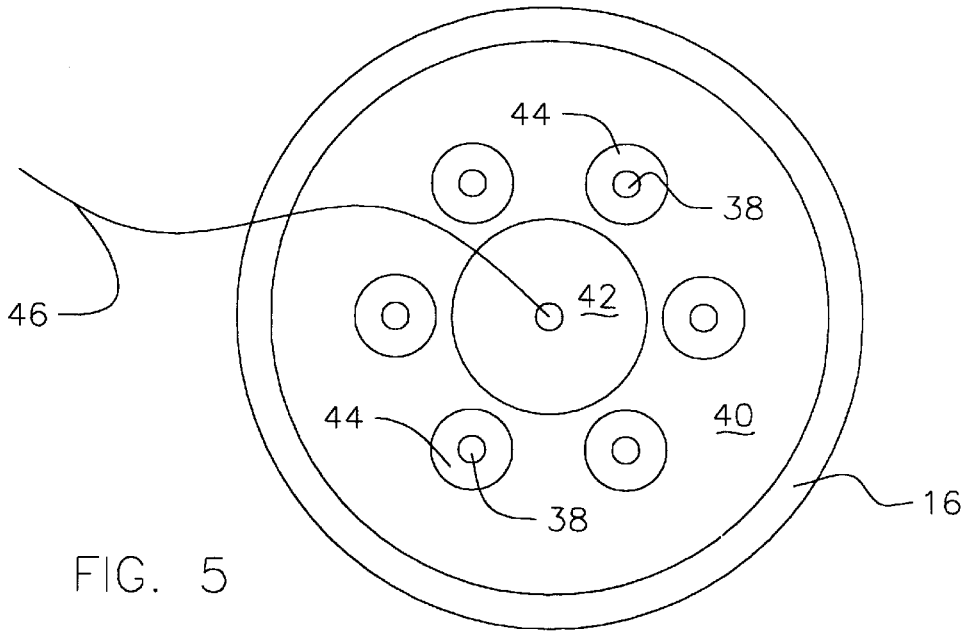
FIG. 5 is a top view of the engine.

FIG. 6 shows a schematic diagram of turbocharger system 64 which is used to supply air to the engine 10. The turbocharger system 64 comprises first turbocharger 66, second turbocharger 68, and a small liquid driven turbine 70. Exhaust gases from the engine 10 are directed to the gas inlet of gas turbine 72 of the first turbocharger 66. The exhaust gases from the gas turbine 72 are directed to the gas inlet of gas turbine 74 of the second turbocharger 68. The exhaust gas from the gas turbine 74 passes to exhaust system 76.

Compressor 78 of the second turbocharger 68 takes in atmospheric air and supplies compressed air to the inlet of compressor 80 of the first turbocharger 66. Outlet compressed air from the compressor 80 is directed to the engine 10.

The liquid driven turbine 70 drives the drive shaft of compressor 78 of the second turbocharger 68. The liquid driven turbine 70 drives the compressor 78 when the engine 10 is not producing exhaust gas, thus allowing the turbocharger system 64 to provide air to the engine at startup. The liquid driven turbine 70 is not shut off when the engine 10 is running. Therefore, compressor 78 provides a higher pressure inlet air stream to the compressor 80 of the first turbocharger 66 than does a turbocharger system without an auxiliary drive. This allows the turbocharger system 64 to compensate for the increased air supply needs of an accelerating engine.

The embodiments shown and described above are only exemplary. I do not claim to have invented all the parts, elements, or steps described. Various modifications can be made in the construction, material, arrangement, and operation, and still be within the scope of my invention. The description has been limited to a one cylinder engine. A multi-cylinder engine can easily be made. The preferred fuel is methanol, but any suitable fuel can be used.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A variable compression ratio internal combustion engine comprising:

a) an engine block having an engine cylinder, an air inlet and an exhaust exit;

b) a piston reciprocally mounted in the cylinder;

c) a tubular sleeve reciprocally mounted in the cylinder between the piston and the engine block;

d) said sleeve having an inlet port and an outlet port;

e) said sleeve having a threaded region at an end of the sleeve;

f) a threaded closure threaded onto said threaded region of the sleeve; and g) a combustion chamber formed by the inside surface of the sleeve, a top face of the piston and a bottom face of the closure; wherein h) the compression ratio of the engine is adjustable by threading the closure into or out of the sleeve.

2. The variable compression ratio internal combustion engine as defined in claim 1 further comprising a drive mechanism connected to said closure for threading the closure onto or out of said threaded region of the sleeve.

3. The variable compression ratio internal combustion engine as defined in claim 1 further comprising a turbocharger system connected to the air inlet and exhaust exit of the engine block to provide air to the engine, said turbocharger system having a first turbocharger connected in series with a second turbocharger, wherein said second turbocharger has a turbine connected to a drive shaft of a compressor of the second turbocharger, and said turbine allows the turbocharger system to provide air to the engine even when the engine is not producing exhaust gases.

4. The variable compression ratio internal combustion engine as defined in claim 1 further comprising a fuel injector in working relation to the combustion chamber.

5. The variable compression ratio internal combustion engine as defined in claim 4 wherein said fuel injector is positioned in the air inlet of the engine block.

6. The variable compression ratio internal combustion engine as defined in claim 4 wherein the fuel injector is supplied with fuel from a high pressure pump which is driven by reciprocating motion of the sleeve.

7. The variable compression ratio internal combustion engine as defined in claim 1 further comprising a plug holder positioned in a bore through the closure, said plug holder remains stationary with respect to the engine block when the engine is running; and said plug holder supports a spark plug which provides spark to the combustion chamber.

8. An internal combustion engine having at least one variable compression ratio cylinder, said cylinder comprising:

a) a reciprocating piston housed inside an engine block;

b) a reciprocating sleeve between the engine block and the piston;

c) a combustion chamber formed by an inside surface of the sleeve, a top face of the piston, and a bottom face of a closure;

d) said closure threaded onto the sleeve; and wherein e) volume of the combustion chamber, and thus the compression ratio, can be changed by threading the closure into or out of the sleeve.

9. The internal combustion engine having at least one variable compression ratio cylinder as defined in claim 8 further comprising a turbocharger system connected to an air inlet and an exhaust exit of the engine block to provide air to the engine, said turbocharger system having a first turbocharger connected in series with a second turbocharger, wherein said second turbocharger has a turbine connected to a drive shaft of a compressor of the second turbocharger, and said turbine allows the turbocharger system to provide air to the engine even when the engine is not producing exhaust gases.

10. The internal combustion engine having at least one variable compression ratio cylinder as defined in claim 8 further comprising a drive mechanism connected to said closure for threading the closure into or out of said sleeve.

11. The internal combustion engine having at least one variable compression ratio cylinder as defined in claim 8 further comprising a fuel injector in working relation to the combustion chamber.

12. The internal combustion engine having at least one variable compression ratio cylinder as defined in claim 8 wherein said fuel injector is positioned in the air inlet of the engine block.

13. The internal combustion engine having at least one variable compression ratio cylinder as defined in claim 12 wherein the fuel injector is supplied with fuel from a high pressure pump which is driven by reciprocating motion of the sleeve.

* * * * *